United States Patent [19]

Couturier

[11] Patent Number: 4,751,807

[45] Date of Patent: Jun. 21, 1988

[54] AUTOMATIC TRANSFER SYSTEM

[75] Inventor: Dennis Couturier, Washburn, Wis.

[73] Assignee: C. G. Bretting Manufacturing Co., Ashland, Wis.

[21] Appl. No.: 40,263

[22] Filed: Apr. 17, 1987

[51] Int. Cl.[4] ..... B65B 63/04; B65B 63/02

[52] U.S. Cl. ..... 53/429; 53/439; 53/530; 493/444

[58] Field of Search ..... 53/429, 439, 202, 530, 53/529; 493/444; 414/105, 106

[56] References Cited

U.S. PATENT DOCUMENTS

| | | | |
|---|---|---|---|
| 2,011,236 | 8/1935 | Winter et al. | 53/439 X |
| 3,044,228 | 7/1962 | Peterson | 53/439 X |
| 3,331,183 | 7/1967 | Gass | 53/202 X |
| 3,656,271 | 4/1972 | O'Shea et al. | 53/429 |
| 3,729,886 | 5/1973 | Lucas et al. | 53/439 X |
| 3,766,701 | 10/1973 | Besserdich et al. | 53/429 X |
| 3,866,905 | 2/1975 | Trogan et al. | 271/181 |
| 3,977,152 | 8/1976 | Rochla et al. | 53/429 |

OTHER PUBLICATIONS

Document Listed as "Exhibits A" and B.

*Primary Examiner*—James F. Coan

*Attorney, Agent, or Firm*—Faegre & Benson

[57] ABSTRACT

A machine for parallel processing a group of clips of stacked interfolded paper sheets having a base, a reciprocating table carrying projectable pins for advancing the group of clips, a clip spreading station for increasing clip-to-clip spacing transverse to the direction of advance of the reciprocating table, a pre-compression station for compressing the clips to a uniform height, a rotation station for selectively rotating each clip 90° length to width, and a folding station having selectively operable opposed blades parallel to the width for forming each clip into a generally U-shaped configuration to fit within a cube-like package.

37 Claims, 5 Drawing Sheets

10
12
14
15
28
34
74
110
112
116
118
120
122
124

AUTOMATIC TRANSFER SYSTEM

BACKGROUND OF THE INVENTION

With the development of automated machinery such as that which accomplishes interfolding of paper tissues and separation of clips from the stack of such interfolded tissues, and also with the advent of automated machinery for putting such clips of tissues into cartons, it has been found desirable to automate the transfer and processing of such clips as they pass from such interfolding/clip separating machines and such packaging machines.

DETAIALED DESCRIPTION

Figure 1A:
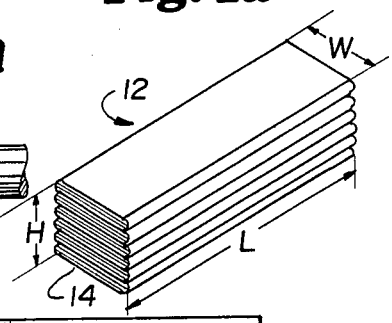
FIG. 1*a* is a perspective view of a clip made up of stacked interfolded paper sheets.
Figure 1:
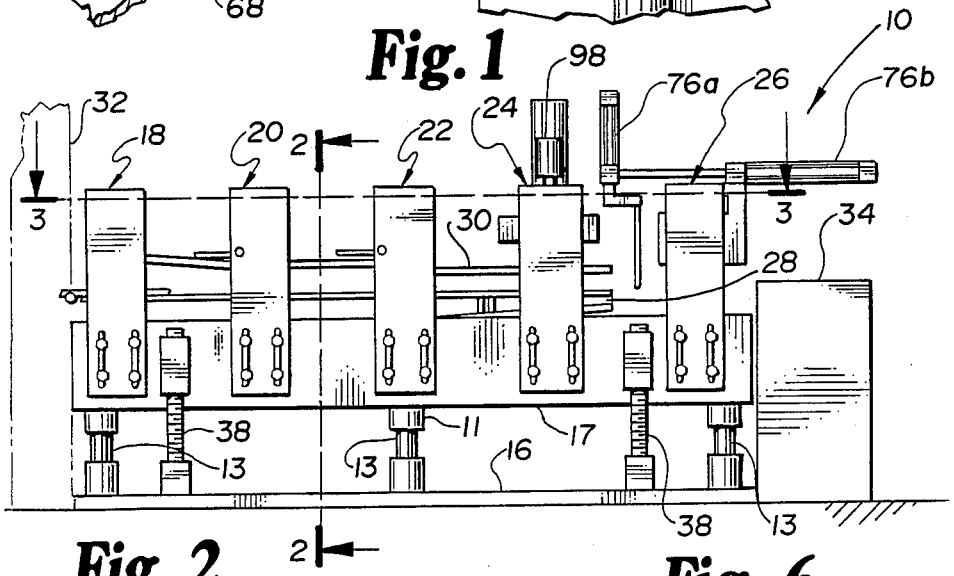
FIG. 1 shows a right side elevation view of an automatic transfer system or machine of the present invention.

Referring now to FIG. 1, a machine or automatic transfer system 10 is shown, suitable for parallel processing groups of clips of stacked paper sheets.

Referring now to FIG. 1*a*, an individual clip 12 of interfolded paper sheets 14 is shown. Clip 12 is characterized by an exterior envelope of the form of a rectangular parallelepiped having a height H and, typically, a length L greater than a width W. It is to be understood that clip 12 may be formed of laminar products other than paper, and need not be interfolded for purposes of this invention.

Machine 10 has a frame 11 and is preferably mounted on a base 16 and preferably has a plurality of stations 18–26 to be described in more detail hereinafter. Although machine 10 is shown with five stations, it is to be understood that machine or system 10 may have more or less stations depending upon the number of processing steps desired between the input and output. Machine 10 further has a reciprocating transfer table 28 to move groups of clips in a clip-advance cycle from station to station. Machine 10 further has guides 30 which are stationary with respect to base 16.

Machine 10 is preferably positioned adjacent to and downstream of a sheet interfolding and clip separating machine 32 which provides successive groups of clips to input station 18. Machine 10 is further preferably adjacent to and upstream of further processing machinery 34 which may, for example, be a conveyor to feed a packaging or cartoner machine to package individual clips processed by machine 10.

Figure 2:
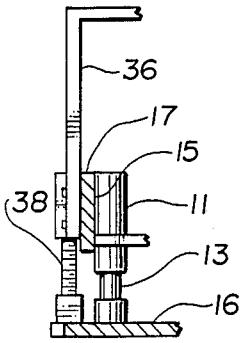
FIG. 2 is a fragmentary section view taken along the line 2—2 of FIG. 1.

Referring now to FIG. 2, stations 18–26 are each preferably mounted on inverted U channel member 36 and are adjustable as a set with respect to base 16 by screw jacks 38 which are preferably interconnected together to be simultaneously operable through a shared drive means, which, for example may be a chain drive linking height adjusting nuts on screw jacks 38 (not shown). It is to be understood that once individual stations are properly installed and adjusted screw jacks 38 change the height of guides 30 and stations 18–26 all together with respect to table 28 (which is mounted for reciprocation with respect to frame 11) to accommodate differing heights of clips 12. This has been found useful in accommodating different counts of sheets which are interfolded into clip 12; for example machine 10 may be adjusted from 100 count to 200 count clips simply by one adjustment controlling all screw jacks 38 simultaneously. Frame 11 is preferably supported by rigid legs 13. A sliding interface 15 between a rail 17 (to which members 36 are attached) and frame 11 permits such adjustment.

It is to be further understood that since each station is mounted by its own channel member 36, individual stations are modular in that they are individually replaceable for maintenance purposes without disturbing adjustment of other stations. Such modularity permits a degree of interchangeability of parts and a reduction in the number of spare parts required to be kept on hand. Additionally, if future improvements are desired to be made to system 10, such modularity permits a greater degree of flexibility in installing such improvements. For example, it may be found to be desirable to further process the top layer of the group of clips passing station 20, and in such event, additional machinery may be installed at station 20 without disturbing the remainder of system 10.

Figure 3:
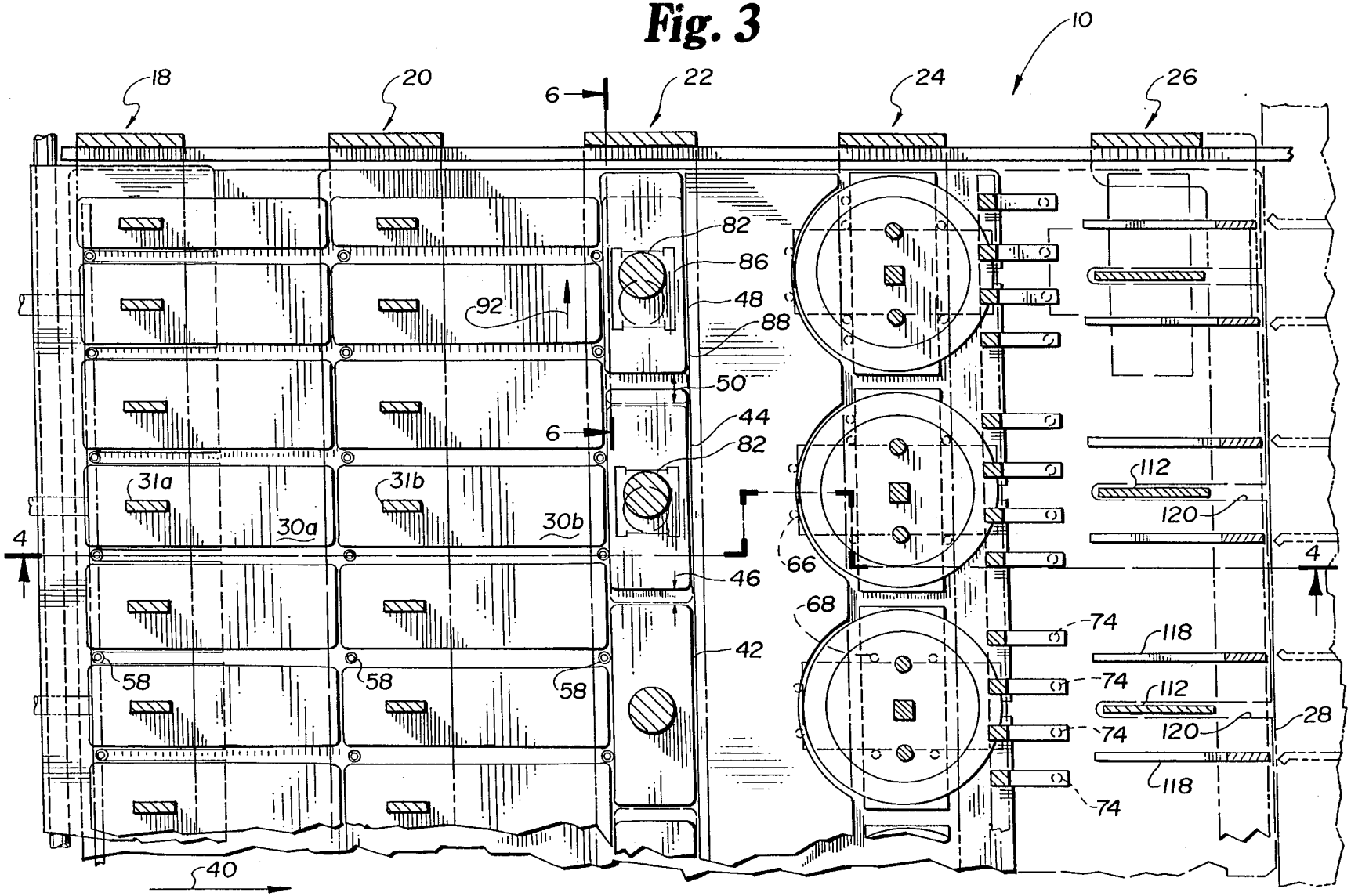
FIG. 3 is a top or plan partial section view taken along line 3—3 of FIG. 1.

Referring now to FIG. 3, machine 10 is designed to receive and process a plurality or group of clips, moving them from station to station in a direction of advance 40 through machine 10. To illustrate certain aspects of this machine, a portion of the machine which is capable of handling a group three clips wide is shown, however it is to be understood that any number of clips in a group may be appropriately handled.

As a group of clips is received by machine 10, it enters input station 18. It is to be further understood, that as clips are received at input station 18, they are commonly adjacent each other in their respective group, and may in fact be somewhat interleaved at adjacent edges within the group as a result of the interfolding process which may interfold a group of clips in parallel. Such interleaving is undesirable since it interferes with further processing of the clips. A spreader station 22 increases the clip-to-clip spacing transverse to the direction of advance 40 such that clips in a particular group are more widely spaced upon leaving than they were upon entering machine 10 at input station 18. This is accomplished by clamping against each clip in the group then at station 22 and transversely driving adjacent clips in that group a desired distance apart, as illustrated in FIG. 3, where the clip at position 42 is not transversely moved, while a clip at position 44 is transversely moved a distance 46 and a clip at position 48 is transversely moved a distance 50.

Machine 10 also preferably includes a rotation station 24 which will rotate individual clips 90° such that the clip length dimension is oriented from perpendicular to parallel to the direction of advance 40. It is to be understood that this step of rotating the clips is optional, and it is dependent upon which orientation the clips are desired to be in upon exiting system 10.

Figure 4A:
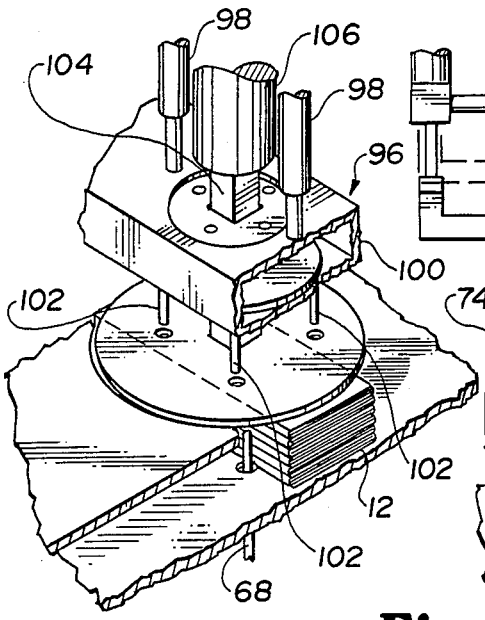
FIG. 4*a* is a fragmentary perspective view of a mechanism for rotating a clip at a rotation station.
Figure 4:
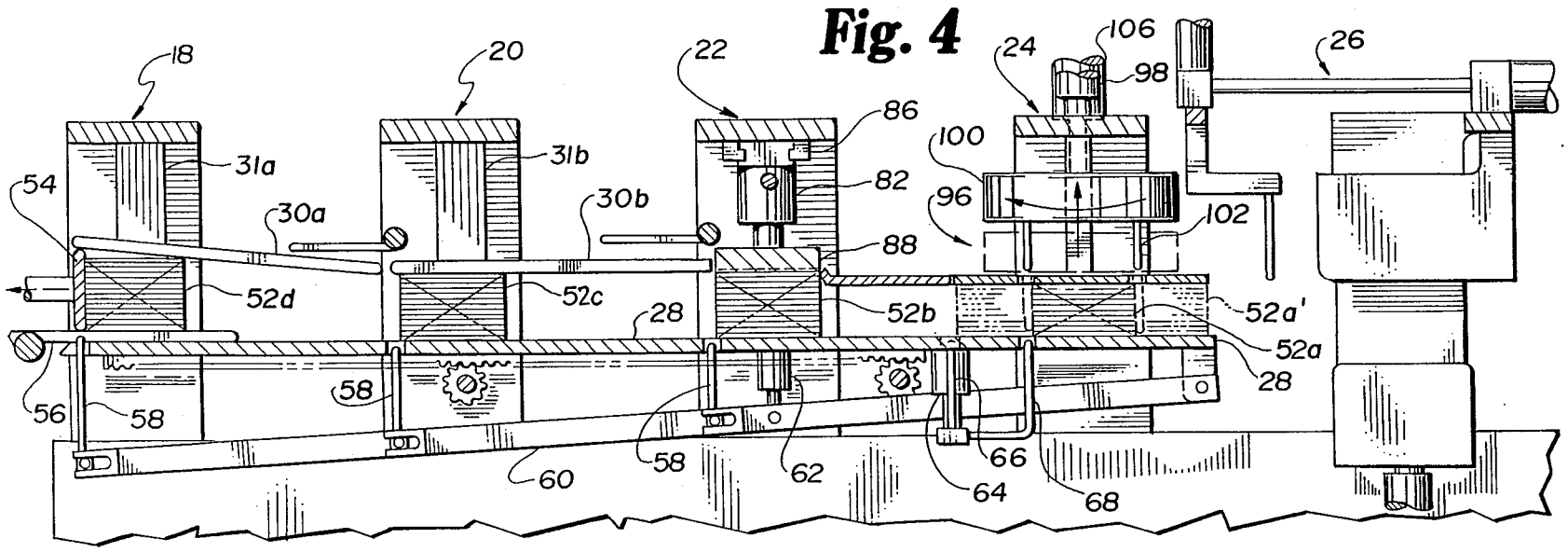
FIG. 4 is a right side section view taken along line 4—4 of FIG. 3 with machine elements shown at the beginning of a clip-advance cycle.

Referring now to FIG. 4, table 28 extends beneath input station 18, pre-compression station 20, spreader station 22, and rotation station 24 at the beginning of a clip advance or transfer cycle. In FIG. 4, four groups of clips 52*a–d* are shown. The last group of clips to be loaded into machine 10 is group or plurality 52*d* which has been loaded by pusher 54 from a preceding machine. In the event that group 52*d* is defective, it may be dumped by pivoting reject gate 56 which eliminates unnecessary further processing of defective groups of clips.

Guides 30a,b are secured to channel 36 by respective ribs 31*a,b*. Pre-compression station reduces the height of a group of clips by pre-compressing the clips in that group by operation of guides 30*a,b*. It is to be understood that clips progressing from station 18 to station 20 may contain entrapped air which will be expelled by such pre-compression Referring now also to FIG. 5, the first step in a clip advance cycle is to raise a plurality of draw pins 58 such that pins 58 project through table 28 adjacent clips 52. Pins 58 are preferably raised by bar 60 driven by actuator 62 which may be a hydraulic or pneumatic cylinder. Depending upon the orientation of the clips in group 52*a*, auxiliary cylinder 64 may also be actuated, raising pins 68.

Figure 7:
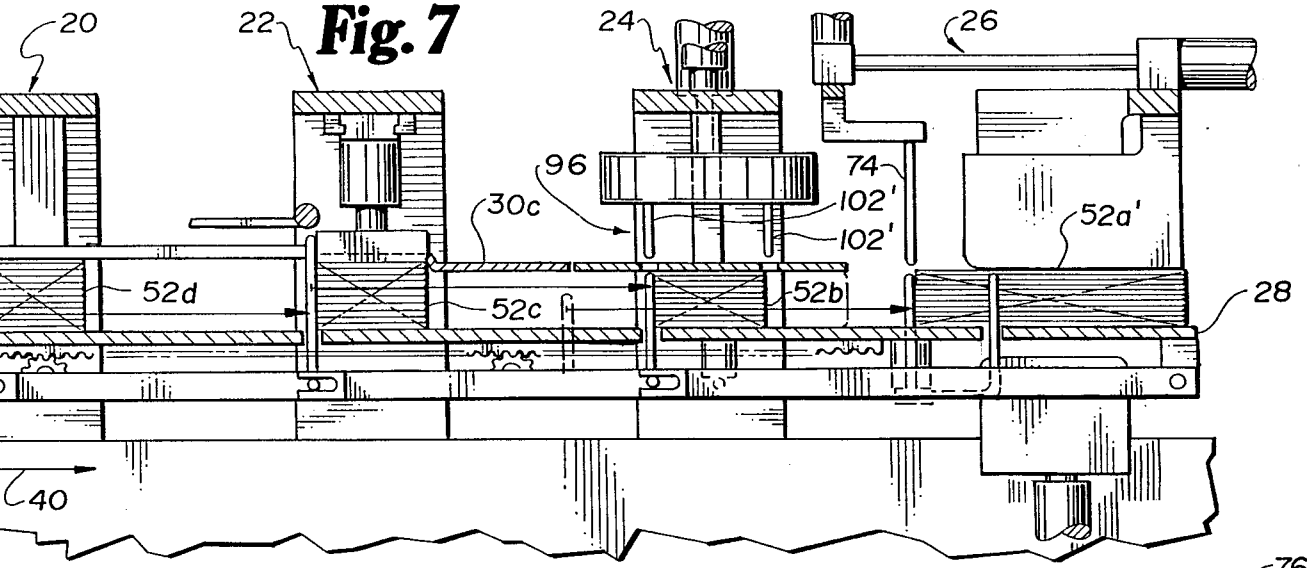
FIG. 7 is a view similar to that of FIG. 5 but with machine elements at a further stage in a clip advance cycle.

Referring now also to FIG. 7, table 28 advances a distance equal to the station-to-station distance in the direction of advance 40 moving each group of clips forward one station. In FIG. 7, the furthest processed group of clips 52*a'* is shown as having been rotated at rotation station 24 before being advanced to forming station or position 26. Table 28 is now in the advanced position.

Figure 8A:
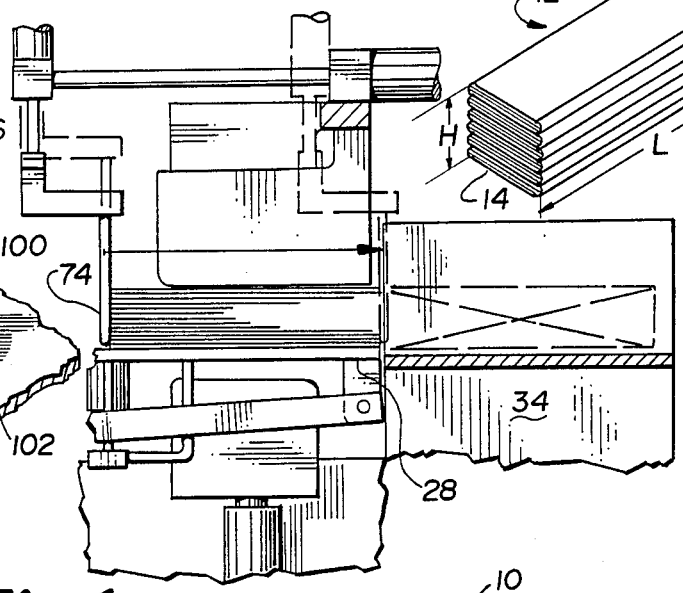
FIG. 8*a* is a fragmentary section view of the outlet portion of the system showing the discharge of a clip from the system.
Figure 8:
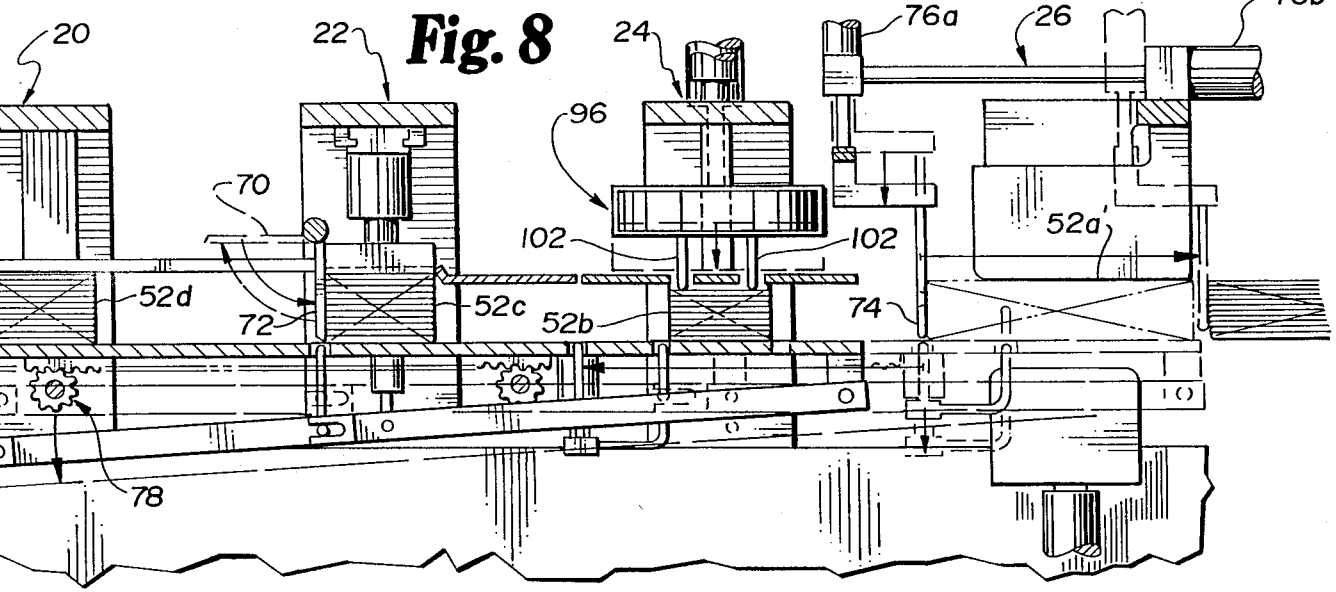
FIG. 8 is a view similar to that of FIG. 7 but with machine elements at a further stage in the clip advance cycle.

Referring now also to FIG. 8, pins 58 are retracted below table 28 as are pins 68 if necessary, stripper pins 70 are actuated to position 72, and group 52*a* is ejected from system 10 by ejector pins 74 being actuated downward and rightward by cylinders 76*a,b*. It is to be understood that this processing shows an operation with clip rotation at station 24 but without clip forming at station 26, discharging "flat grade" or unformed clips to conveyor 34.

With pins 70 in position 72 and pins 58 and 68 retracted below table 28, table 28 is itself retracted to the position shown in FIG. 8, which corresponds to that in FIG. 4. It should be noted, however, that groups of clips 52*a–d* have been advanced one station, and meanwhile a new group of clips 52*e* has been received at input station 18. Table 28 may be advanced and retracted by a rack and pinion drive 78 or other suitable means, such as air cylinders.

Figure 6:
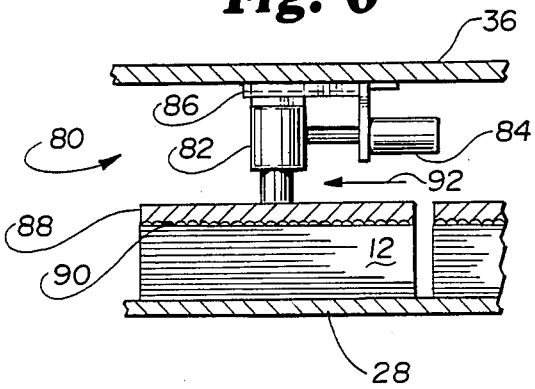
FIG. 6 is a fragmentary section view taken along line 6—6 of FIG. 3 showing details of a part of a clip spreader station.

Referring now also to FIG. 6, a more detailed view of the structure of one fixture in the spreader station is as follows. A clip spreader assembly 80 is mounted on channel 36 at station 22. Assembly 80 includes a first actuator 82 and a second actuator 84, which may be pneumatic air cylinders. Actuator 84 is rigidly secured to channel 36, while actuator 82 is mounted for sliding movement with respect to channel 36 by track 86. A serrated or scalloped clamp plate 88 is mounted to actuator 82. Serrations 90 provide a surface texture for plate 88 aligned with the direction of advance 40 to permit relative ease of entry and exit of clip 12 into and out of spreader station 22 while providing a sufficient gripping force on clip 12 transverse to direction 40. Serrations 90 have been found useful for driving clip 12 laterally in direction 92, transverse to the direction of advance 40.

The operation of spreader station 22 is as follows. As a result of a clip advance cycle, group of clips 52*c* is transferred to spreader station 22 as in FIG. 7. Actuator 82 drives plate 88 against each clip 12 in group 52*c*, as shown by arrow 53 in FIG. 5. Next, actuator 84 drives adjacent clips 12 in group 52*c* laterally in the transverse direction 92, as shown in FIG. 3. It is to be understood that one clip in the group need not be driven transversely. Once spread, the clips in group 52*c* are held compressed by plate 88, until the next clip advance cycle moves group 52*c* out of station 22 and under guide30*c*. After release of the spread clips, assembly 88 retracts to a starting position indicated in FIG. 7 showing retraction of plate 88 in the clip-height direction. Actuator 84 also retracts plate 88 in the lateral direction opposite to arrow 92 to a ready position for a new clip spreading cycle on group 52*d* when that group is received at spreader station 22.

Figure 5:
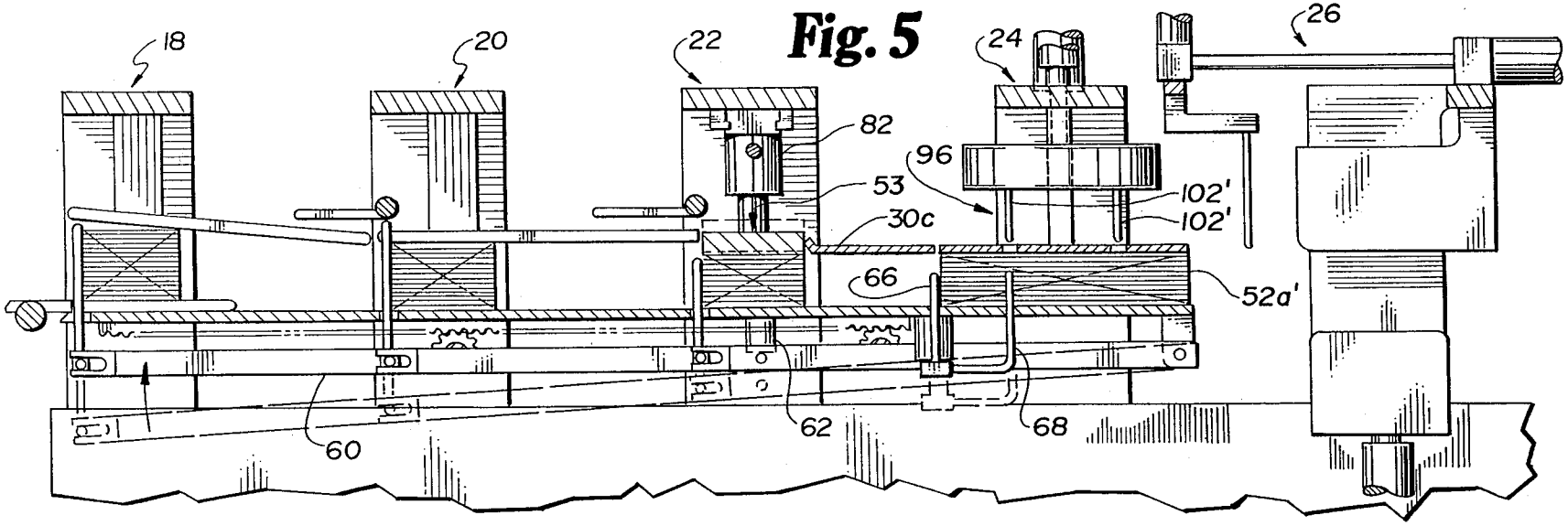
FIG. 5 is a view similar to that of FIG. 4, but with machine elements at a further stage in a clip-advance cycle.

Referring now also to FIG. 4*a*, the structure and operation of rotation station 24 is as follows. FIGS. 4 and 8 show a preferred embodiment and FIGS. 5 and 7 show an alternative embodiment for rotation pin assembly 96. One or more actuators 98 are adapted to drive pin carriage 100 up and down to raise and lower pins 102 against each clip 12 in the group then at station 24. In FIG. 4, group 52*a* is the group of clips then at station 24. Actuating pin carriage 100 causes pins 102 to engage the top surface of the clip, as shown in FIG. 8. In an alternative embodiment, pins 102' may be more widely spaced as shown in FIGS. 5 and 7 to engage the sides of each clip then present at station 24. In either event, pins 102 drive clip 12 rotationally to a position 52*a'* as shown in FIGS. 4 and 5. Rotation is accomplished by rotating carriage 100 through shaft 104 driven by an actuator 106 which may be a rack and pinion driven by an air cylinder, an electric or pneumatic angular positioning motor, or other conventional means. It is to be understood that rotation of clips 12 at this station is optional, depending upon the desired orientation of clips to be further processed, and also that hold-down pins 102 serve the function that stripper pins would serve at this station, i.e., pins 102 retain the clips then present at station 24 while table 28 is retracted as shown in FIG. 8.

Referring now also to FIG. 8*a*, if the clips in rotated group 52*a'* are not needed to be further processed, they are ejected by ejector pins 74 to conveyor 34 while table 28 is in the advanced position as shown in FIG. 8*a*.

Figures 9, 10, 11, 12, 13, 14, 15:
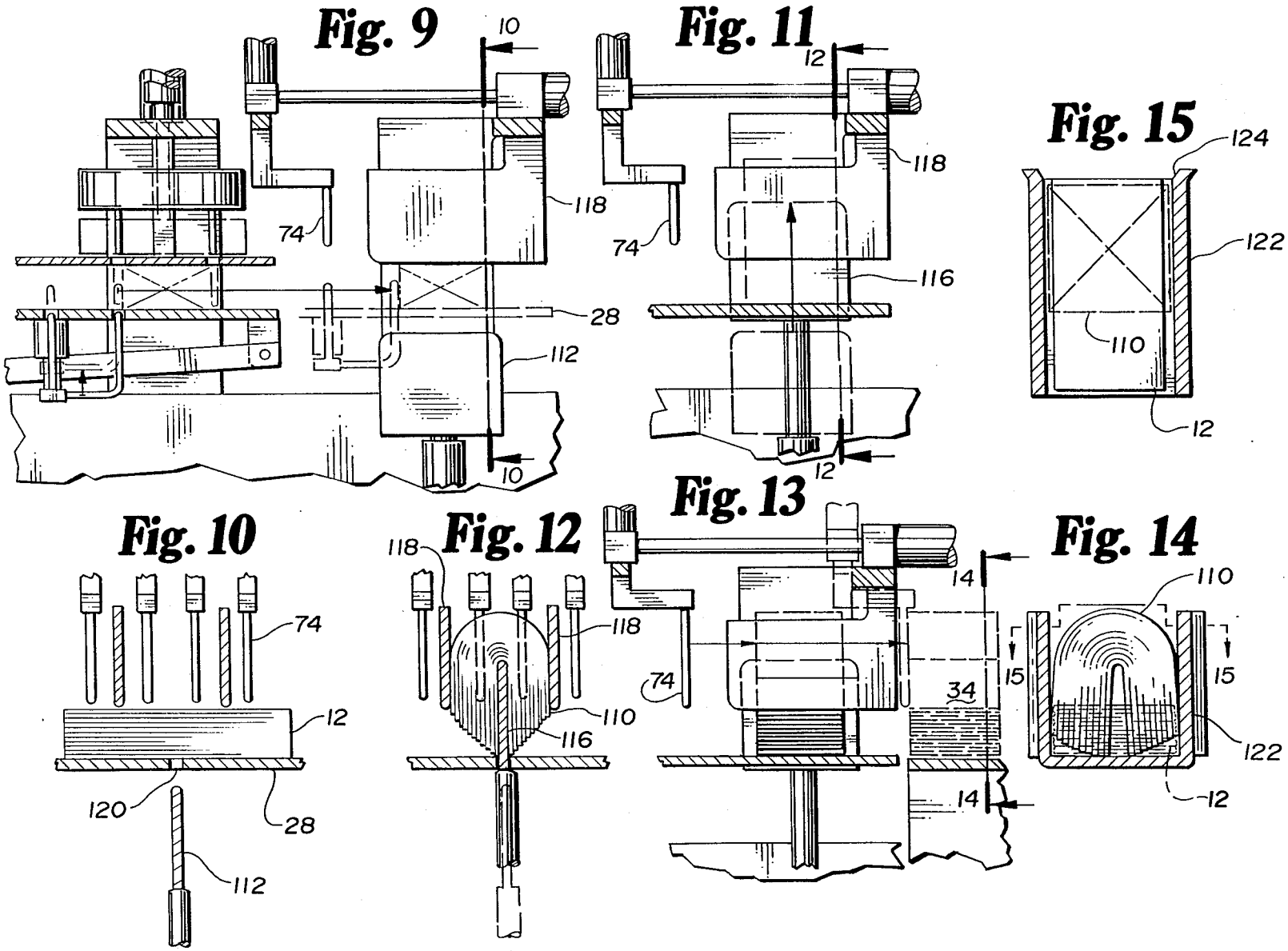
FIG. 9 is a fragmentary section view of the last two stations in the system, showing further details thereof.
FIG. 10 is a fragmentary section view taken along line 10—10 of FIG. 9 showing details of a clip forming station.
FIG. 11 is a fragmentary section view of the machine elements of the forming station showing the operation thereof.
FIG. 12 is a fragmentary section view taken along line 12—12 of FIG. 11.
FIG. 13 is a view similar to FIG. 11, showing discharge of a formed clip from the forming station.
FIG. 14 is a section view taken along line 14—14 of FIG. 13.
FIG. 15 is a section view taken along line 15—15 of FIG. 14.

Referring now also to FIGS. 10–15, the structure and operation of forming station 26 may be seen. FIG. 10 shows an unrotated clip 12 received at forming station 26 on table 28. If it is desired to form clip 12 into a generally U-shaped configuration 110, blade 112 is actuated by an actuator 114 (which may be an air cylinder) to position 116, forming clip 12 into configuration 110 by forming clip 12 between blades 116 and 118. Table 28 has slots 120 (which may be seen more clearly in FIGS. 3 and 10) to accommodate blades 112. After clips have been formed into the U-shaped configuration, ejector pins 74 transfer the clips of the group then at forming station 26 to conveyor 34.

It is to be understood that, while it is preferable that clip spreading, rotation and forming all take place with table 28 in the advanced position, other timing of station activity with respect to table reciprocation is within the contemplation and scope of this invention.

Conveyor 34 carries magazines as shown in FIGS. 14 and 15, to receive formed or unformed clips. Magazine 122 preferably a two-sided structure having a flared inlet 124 for receiving either an unformed clip 12, or a formed clip 110. Conveyor 34 then carries that group of clips away and presents a new group of empty magazines 122 adjacent forming station 26 at the time pins 74 are ready to eject a new group of clips from that station.

The invention is not to be taken as limited to all of the details thereof as modifications and variations thereof may be made without departing from the spirit or scope of the invention; accordingly,

What is claimed is:

1. An automatic transfer system for parallel processing a group of clips of stacked laminar products comprising:

(a) a machine frame having:

(i) a base, and (ii) advancing means mounted on said base having reciprocating means carrying selectively projectable pins for periodically advancing a group of clips; and (b) a clip spreading station having:

(i) spreader means for increasing clip-to-clip spacing transverse to the direction of advance of said advancing means such that the clips in a group are more widely spaced upon leaving than upon entering said system.

2. The system of claim 1 wherein said folding means further comprises opposed blades parallel to said width, with relative movement of a first blade intermediate a pair of second blades such that said clip is formed into the U-shaped configuration when said first and second blades are drawn together.

3. The system of claim 1 wherein said spreader means comprises a plate for each clip having a surface texture with relatively lower friction in the direction of advance and a relatively higher friction transverse to the direction of advance.

4. The system of claim 3 wherein said spreader means further comprises transverse drive means for driving at least one plate transverse to the direction of advance.

5. The system of claim 4 wherein said transverse drive means comprises a selectively actuable air cylinder.

6. The system of claim 1 further comprising:

(c) a pre-compression station positioned before said clip spreading station and having pre-compression means for receiving clips of varying heights and for compressing said clips to a pre-compression uniform height.

7. The system of claim 6 wherein said pre-compression means comprises guide rails positioned with respect to said advancing means in a spaced relationship which tapers from a relatively wide to a relatively narrow spacing in the direction of advance of said advancing means.

8. The system of claim 6 wherein said clip spreading station further comprises:

(ii) compression means for further compressing said clips from said pre-compression height to a final clip height.

9. The system of claim 8 wherein said compression means comprises an air cylinder operable in the clip height direction.

10. The system of claim 1 wherein said clips are generally rectangular with length unequal to width, said system further comprising:

(d) a rotation station having selectively operable rotation means for rotating each clip generally 90° such that each clip is reoriented length to width.

11. The system of claim 10 wherein each said station is modular and individually replaceable without disturbing other stations in said system.

12. The system of claim 1 wherein said clips are non-cubic rectangular parallelepipeds with length greater than width, said system further comprising:

(e) a folding station having selectively operable folding means for forming each clip into a generally U-shaped configuration such that each formed clip will fit within a rectangular package whose edge dimension is generally equal to the smaller of the unformed clip width.

13. A method of longitudinally advancing and positioning successive groups of clips of stacked laminar products from an input station to an output position and transversely spreading the clips in each group by moving said clips in groups from station to station comprising:

(a) reciprocating a table in a direction of advance from a first position to a second position such that said table stops adjacent a plurality of stations at each of said first and second positions;

(b) reciprocating a plurality of pins generally orthogonal to said table such that:

(i) said pins project from the plane of said table when said table moves forward in the direction of advance, and (ii) said pins are recessed below the plan of said table when said table moves backward against the direction of advance; and (c) spreading the clips in a particular group while that group is at a spreader station such that the clip-to-clip separation in a direction transverse to the direction of advance is increased.

14. The method of claim 13 further comprising:

(e) forming each clip in a group then present at a forming station into a generally U-shaped configuration such that the effective length of each clip in that group is substantially lessened.

15. The method of claim 13 wherein said spreading step further comprises:

(c1) clamping a plate against each clip in that group;

(c2) driving at least one plate transversely to the direction of advance to spread the clips in that group; and (c3) retracting said plates to an unclamped and unspread position.

16. The method of claim 13 further comprising:

(d) rotating each clip in a particular group while that group is at a rotating station such that each clip in that group is rotated length for width relative to the direction of advance.

17. The method of claim 16 wherein said rotating step further comprises:

(d1) extending clamping means against each clip at the rotating station in a direction towards said table;

(d2) rotating each clip at the rotating station substantially 90° by driving through said clamping means; and (d3) retracting said clamping means to an unextended position.

18. The method of claim 17 wherein said clamping means comprises a set of pins projecting into the top surface of each clip at the rotating station.

19. The method of claim 17 wherein said clamping means comprises a set of pins projecting along side of each clip at the rotating station.

20. The method of claim 14 wherein said forming step further comprises:

(e1) projecting a first blade transverse to the length of the clips at the forming station generally at the mid point of each such clip;

(e2) opposing the projecting of said first blade by a pair of opposed second blades transverse to said clip length and spaced substantially equidistant from said first blade by half the desired effective length of said formed clip such that second blades are exterior of, and said first blade is interior of, the U-shaped configuration;

(e3) moving each said formed clip out of said forming station; and (e4) retracting said first blade.

21. The method of claim 20 wherein said forming step occurs while said table is in said forward position.

22. A machine for transferring and processing clips of interfolded paper sheets comprising:

(a) a base;

(b) transfer means adjustably mounted on said base for advancing a plurality of clips from station to station;

(c) an input station mounted on said base for receiving a plurality of adjacent clips;

(d) a pre-compression station mounted on said base for reducing the height of said clips below that at said input station;

(e) a spreader station mounted on said base for providing separation among said plurality of clips;

(f) a rotation station mounted on said base for selectively rotating each clip then at that station 90°; and (g) a forming station mounted on said base for selectively forming each clip then at that station into a U-shaped configuration.

23. The machine of claim 22 wherein said stations are modular such that each such station may be removed without disturbing other stations of said machine.

24. The machine of claim 22 further comprising height adjustment means for simultaneously adjusting the clearance between said stations and said station transfer means for various heights of clips resulting from various counts of paper sheets in said clips.

25. The machine of claim 24 wherein said height adjustment means comprises a plurality of screw jacks simultaneously adjustable through a shared drive means.

26. The machine of claim 22 wherein said transfer means advances and retracts with respect to said stations and further comprising retention means at said pre-compression and rotation stations for retaining the clips at those stations as said transfer means retracts.

27. An automatic transfer system for parallel processing a group of clips of stacked laminar products comprising:

(a) a machine frame having:

(i) a base, and (ii) advancing means mounted on said base for periodically advancing a group of clips; and (b) a clip spreading station having:

(i) spreader means for increasing clip-to-clip spacing transverse to the direction of advance of said advancing means such that the clips in a group are more widely spaced upon leaving than entering said system wherein said spreader means comprises a plate for each clip having a surface texture with relatively lower friction in the direction of advance and a relatively higher friction transverse to the direction of advance.

28. The system of claim 27 wherein said folding means further comprises opposed blades parallel to said width, with relative movement of a first blade intermediate a pair of second blades such that said clip is formed into the U-shaped configuration when said first and second blades are drawn together.

29. The system of claim 27 herein said spreader means further comprises transverse drive means for driving at least one plate transverse to the direction of advance.

30. The system of claim 29 wherein said transverse drive means comprises a selectivey actuable air cylinder.

31. The system of claim 27 further comprising:

(c) a pre-compression station positioned before said clip spreading station and having pre-compression means for receiving clips of varying heights and for compressing said clips to a pre-compression uniform height.

32. The system of claim 31 wherein said pre-compression means comprises guide rails positioned with respect to said advancing means in a spaced relationship which tapers from a relatively wide to a relatively narrow spacing in the direction of advance of said advancing means.

33. The system of claim 31 wherein said clip spreading station further comprises:

(ii) compression means for further compressing said clips from said pre-compression height to a final clip height.

34. The system of claim 33 wherein said compression means comprises an air cylinder operable in the clip height direction.

35. The system of claim 27 wherein said clips are generally rectangular with length unequal to width, said system further comprising:

(d) a rotation station having selectively operable rotation means for rotating each clip generally 90° such that each clip is reoriented length to width.

36. The system of claim 35 wherein each said station is modular and individually replaceable without disturbing other stations in said system.

37. The system of claim 27 wherein said clips are non-cubic rectangular parallelepipeds with length greater than width, said system further comprising:

(e) a folding station having selectively operable folding means for forming each clip into a generally U-shaped configuration such that each formed clip will fit within a rectangular package whose edge dimension is generally equal to the smaller of the unformed clip width.

* * * * *